US007580002B2

(12) United States Patent
Noro

(10) Patent No.: US 7,580,002 B2
(45) Date of Patent: Aug. 25, 2009

(54) ANTENNA UNIT WITH A TOP COVER PAINTED IN ONE OF VARIOUS COLORS

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 524 days.

(21) Appl. No.: 11/412,546

(22) Filed: Apr. 27, 2006

(65) Prior Publication Data

US 2006/0273968 A1 Dec. 7, 2006

(30) Foreign Application Priority Data

Jun. 7, 2005 (JP) ..... 2005-167250

(51) Int. Cl.
*H01Q 1/42* (2006.01)
*H01Q 1/32* (2006.01)

(52) U.S. Cl. ..... 343/872; 343/713

(58) Field of Classification Search ..... 343/713, 343/700 MS, 872, 711, 712
See application file for complete search history.

(56) References Cited

U.S. PATENT DOCUMENTS

| | | | | |
|---|---|---|---|---|
| 6,129,443 | A | 10/2000 | Murata et al. | |
| 7,151,674 | B2 | 12/2006 | Sasaki et al. | |
| 2003/0174095 | A1 * | 9/2003 | Sievenpiper | 343/770 |
| 2004/0246196 | A1 | 12/2004 | Noro et al. | |
| 2005/0225489 | A1 * | 10/2005 | Aizawa et al. | 343/173 |
| 2006/0279468 | A1 * | 12/2006 | Yoneya et al. | 343/713 |

FOREIGN PATENT DOCUMENTS

| | | | |
|---|---|---|---|
| JP | 58-86953 | U | 6/1983 |
| JP | 61-1773 | U | 1/1986 |
| JP | 2-43249 | U | 3/1990 |
| JP | 06-041214 | U | 5/1994 |
| JP | 08-162843 | A | 6/1996 |
| JP | 08-334389 | A | 12/1996 |
| JP | 10-247809 | A | 9/1998 |
| JP | 10-302515 | A | 11/1998 |
| JP | 2002-8476 | A | 1/2002 |
| JP | 2002-355934 | A | 12/2002 |
| JP | 2003-32342 | A | 1/2003 |
| JP | 2003-101256 | A | 4/2003 |
| JP | 2004-228802 | A | 8/2004 |
| JP | 3106279 | U | 10/2004 |
| JP | 2005-093475 | A | 4/2005 |
| JP | 2005-109687 | A | 4/2005 |
| WO | 2005/043869 | A1 | 5/2005 |

OTHER PUBLICATIONS

Japanese Office Action dated Jul. 16, 2008 issued in counterpart Japanese Application No. 2008-1539 and English translation of relevant portions thereof.

* cited by examiner

*Primary Examiner*—HoangAnh T Le
(74) *Attorney, Agent, or Firm*—Frishauf, Holtz, Goodman & Chick, P.C.

(57) ABSTRACT

In an antenna unit having an antenna body and a top cover, the antenna body has a bottom plate having a main surface, an antenna mounted on the main surface of the bottom plate, and an intermediate cover attached on the main surface of the bottom plate. The top cover is fitted to the intermediate cover so as to cover the intermediate cover.

9 Claims, 5 Drawing Sheets

ANTENNA UNIT WITH A TOP COVER PAINTED IN ONE OF VARIOUS COLORS

This application claims priority to prior Japanese patent application JP 2005-167250, the disclosure of which is incorporated herein by reference.

BACKGROUND OF THE INVENTION

This invention relates to an antenna unit and, in particular, to an antenna unit for use in a digital radio receiver for receiving an electric wave from an artificial satellite (that may be also called a "satellite wave" hereinafter) or an electric wave on the ground (that may be also called a "terrestrial wave" hereinafter) to listen to a digital radio broadcasting.

In recent years, a digital radio receiver, which receives the satellite wave or the terrestrial wave so as to listen to the digital radio broadcasting, has been developed and is put to practical use in the United States of America. Specifically, two broadcasting stations called XM and Sirius provide radio programs on 250 or more channels in total. The digital radio receiver is generally mounted on a mobile object such as an automobile and is adapted to receive a radio wave having a frequency of about 2.3 gigahertz (GHz) as a received wave to listen to the digital radio broadcasting. In other words, the digital radio receiver is a radio receiver capable of listening to mobile broadcasting. Inasmuch as the received wave has the frequency of about 2.3 GHz, a reception wavelength (resonance frequency) $\lambda$ thereof is equal to about 128.3 mm. It is noted here that the terrestrial wave is a radio wave obtained by receiving the satellite wave at a ground station, slightly shifting the frequency of the satellite wave, and retransmitting the linear polarized wave. Thus, the terrestrial wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized waves, receives a radio wave by using a terrestrial linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a terrestrial linear polarization portion of the radio antenna apparatus.

As described above, the radio wave having the frequency of about 2.3 GHz is used in the digital radio broadcasting. Therefore, an antenna for receiving the radio wave must be located outside as known in the art. If the digital radio receiver is mounted in the mobile object such as the automobile, the antenna unit is must be attached to a roof of the mobile object (car body). It is therefore necessary for such an antenna unit to be highly resistant to weathering and to render waterproof.

The antenna unit comprises an antenna and an antenna case for covering the antenna. The antenna case comprises a dome-like top cover and a bottom plate. The antenna comprises an antenna element, a circuit board, a shield case, and a shield case. For example, the antenna element may comprise a patch antenna for receiving the satellite antenna. The circuit board is provided with a circuit (hereinafter will be called a signal processing circuit) for performing various kinds of signal processing, such as signal amplification, upon a signal received by the antenna element. The shield case serves to shield the signal processing circuit.

In a case where the antenna unit is attached to the roof of the car body, it is necessary to match color of the top cover in the antenna unit with cover of the car body. It is therefore necessary to coat the top caver of the antenna unit with paint having color which is similar to that of the car body on which the antenna unit is mounted. The car bodies have color variations in abundance. For instance, it will be assumed that there are ten vehicle types each having the color of ten. In this event, it is necessary to support 100 models of the car bodies.

It is therefore in prior art disadvantageous in that types of the antenna units are increased, management thereof is complicated, and it results in degrading production efficiency.

In addition, as an antenna unit related to this invention, an antenna unit capable of surely prevent water from penetrating is known, for example, in United States Patent Application Publication No. 2004/0246196 A1 which will later be called a patent document 1 hereinafter. According to the patent document 1, a gasket for covering at least a periphery of the bottom plate is arranged and the gasket comes into contact with the inner surface of the cover member thereby sealing the inner space. However, the antenna unit disclosed in the patent document 1 has the challenge to surely prevent water from penetrating thereto and no mention is made of how to color of the top cover in the antenna unit.

SUMMARY OF THE INVENTION

It is therefore an object of the present invention to provide an antenna unit which is capable of easily performing management thereof.

It is another object of the present invention to provide an antenna unit which is capable of easily assembling it.

Other objects of this invention will become clear as the description proceeds.

According to an aspect of this invention, an antenna unit comprises a bottom plate having a main surface, an antenna mounted on the main surface of the bottom plate, an intermediate cover attached on the main surface of the bottom plate so as to cover the antenna, and a top cover fitted to the intermediate cover so as to cover the intermediate cover.

In the afore-mentioned antenna, the top cover preferably may comprise a plurality of fixing pieces extending towards the bottom plate on an inner surface thereof. Each of the fixing pieces has a stopper claw at a tip thereof. In this event, the intermediate cover comprises a plurality of engaging parts formed at positions corresponding to the respective stopper claws. The engaging parts are for receiving the respective stopper claws. Thereby, the top cover is fitted to the intermediate cover by engaging the stopper claws with the engaging parts. In addition, the antenna unit may have symmetrical structure which is symmetric with respect to a symmetric plane. In this event, the fixing pieces desirably may be substantially symmetrically placed on the inner surface of the top cover with respect to the symmetric plane. The fixing pieces preferably may be placed on the inner surface of the top cover at regular intervals. The fixing pieces may be equal in number to six or more and the engaging parts may be equal in number to six or more. The top cover may be painted in one selected from various colors.

In the afore-mentioned antenna unit, the antenna unit preferably may further comprise an elastic sheet mounted around the main surface of the bottom plate. The elastic sheet is sandwiched between the intermediate cover and the bottom plate. The antenna unit desirably may further comprise a gasket made of an elastic member for covering at least an outer edge of the bottom plate. In this event, the top cover has a rim edge which comes into contact with a rim edge of the gasket on fitting the top cover with the intermediate cover. The antenna unit preferably may further comprise an elastic sheet mounted around the main surface of said bottom plate and a gasket made of an elastic member for covering at least an outer edge of the bottom plate. In this event, the elastic sheet is sandwiched between the intermediate cover and the bottom plate while the top cover has a rim edge which comes into contact with a rim edge of the gasket on fitting the top cover with the intermediate cover.

DESCRIPTION OF THE PREFERRED EMBODIMENT

Figure 1:
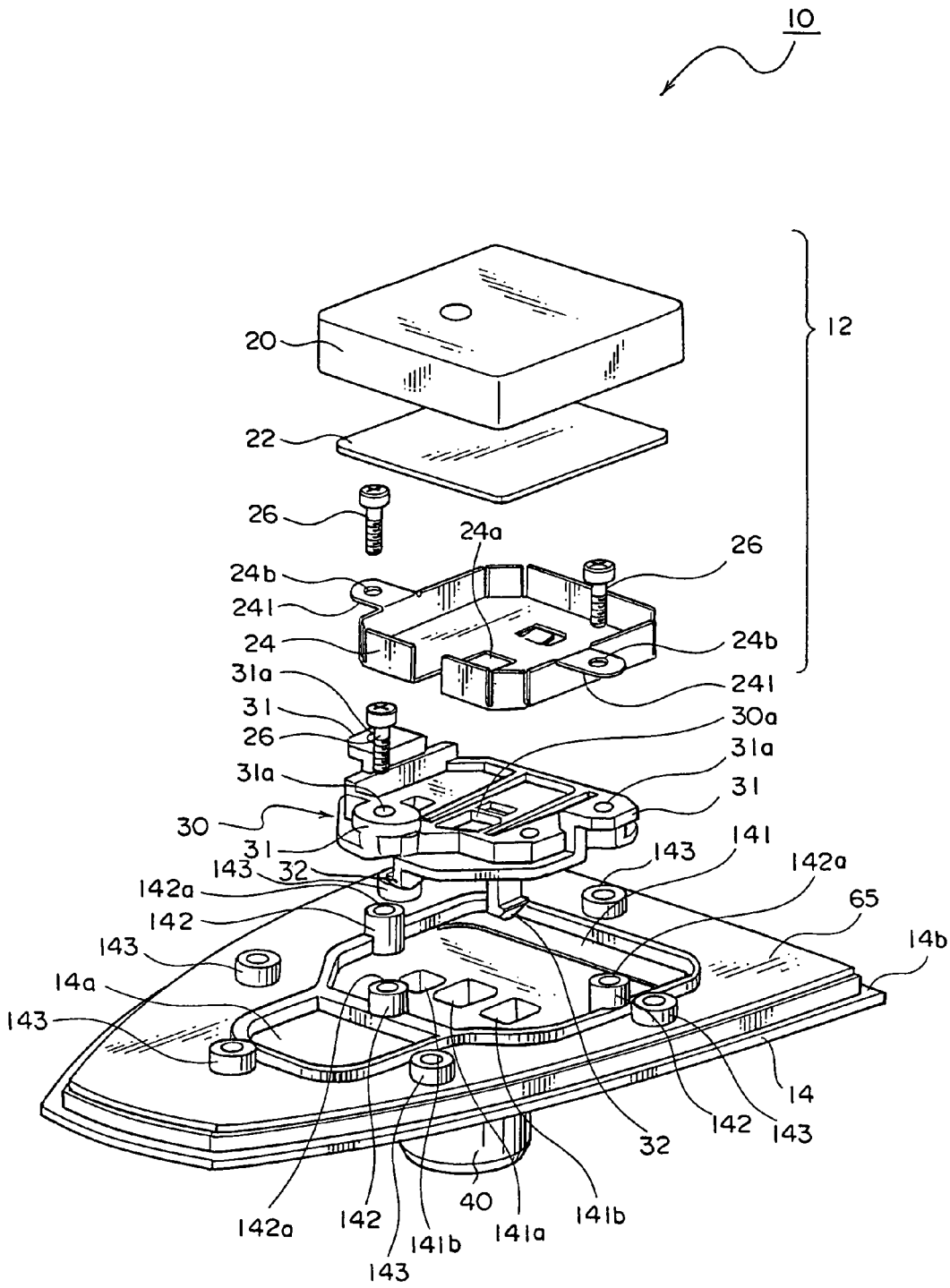
FIG. 1 is an exploded perspective view of an antenna unit according to an embodiment of this invention.

Referring to FIG. 1, the description will proceed to an antenna unit 10 according to an embodiment of the present invention. The illustrated antenna unit 10 is an antenna apparatus for use in a digital radio receiver and is used by attaching to a roof of a mobile object (car body) such as an automobile.

The antenna unit 10 illustrated in FIG. 1 shows a state where an intermediate cover (an inner cover), a top cover (an outer cover), and a gasket, all of which will later be described, are demounted therefrom.

The illustrated antenna unit 10 comprises an antenna 12 and an antenna case (which will later be described) for covering the antenna 12. The antenna case comprises the intermediate cover (the inner cover), a dome-like top cover (the outer cover), and a bottom plate 14. The antenna 12 is accommodated in the intermediate cover (the inner cover) in the manner which will later be described.

The antenna 12 comprises an antenna element 20, a circuit board 22, and a shielding case 24. The illustrated antenna element 20 comprises a patch antenna for receiving a satellite wave. The circuit board 22 is provided with an electric circuit (hereinafter called a signal processing circuit) for performing various kinds of signal processing, such as signal amplification, upon a received signal received by the antenna element 20. The antenna element 20 is connected on a first principal surface of the circuit board 22 by the use of a double-sided adhesive tape (not shown) or the like.

The circuit board 22 is connected to a cable (which is depicted by a reference numeral 80 in FIGS. 2A and 2B) for extracting the received signal to the outside of the antenna case. In addition, the shielding case 24 is attached to a second principal surface opposite to the first principal surface of the circuit board 22. The shielding case 24 is made of metal or conductive material and is secured to four corner portions of the circuit board 22 by soldering. Therefore, the shielding case 24 is electrically connected to the circuit board 22 and serves to electromagnetically shield the signal processing circuit mounted on the circuit board 22.

The shielding case 24 has an opening 24*a* for allowing the cable 80 to pass therethrough. The shielding case 24 has a pair of tabs 241 extending outward from opposite side surfaces thereof. The tabs 241 are provides with through holes 24*b*, respectively, through which a pair of screws 26 pass.

The antenna unit 10 comprises a unit fixing member 30 disposed between the antenna 12 and the bottom plate 14. The unit fixing member 30 is made of resin material. As will later be described in detail, the unit fixing member 30 serves to provisionally fix the antenna unit 10 onto the roof the mobile object (car body) and to fix the antenna 12 onto the bottom plate 14. Thus, the unit fixing member 30 is disposed directly below the antenna 12.

On the other hand, the bottom plate 14 has, on a main surface 14*a* thereof, a recess 141 adapted to receive the unit fixing member 30. The bottom plate 14 has three bosses 142 having three threaded holes 142*a* to be threaded with three screws 26, respectively. Among the three bosses 142, the two bosses are formed positions corresponding to the tabs 241 of the shielding case 24.

The unit fixing member 30 has three boss receiving portions 31 formed at positions corresponding to the three bosses 142 of the bottom plate 14 and adapted to receive the three bosses 142. The boss receiving portions 31 are provided with communication holes 31*a* for penetration of the screws 26, respectively. The unit fixing member 30 has a hole 30*a* allowing the cable 80 to pass therethrough. In addition, the unit fixing member 30 has a pair of claws or hooks 32 extending downward to provisionally fix the antenna unit 10 to the roof of the mobile object (car body).

The bottom plate 14 is provided with a hole 141*a* formed in the recess 141 allowing the cable 80 to pass therethrough and two holes 141*b* allowing the two claws 32 to pass therethrough.

Figure 2B:
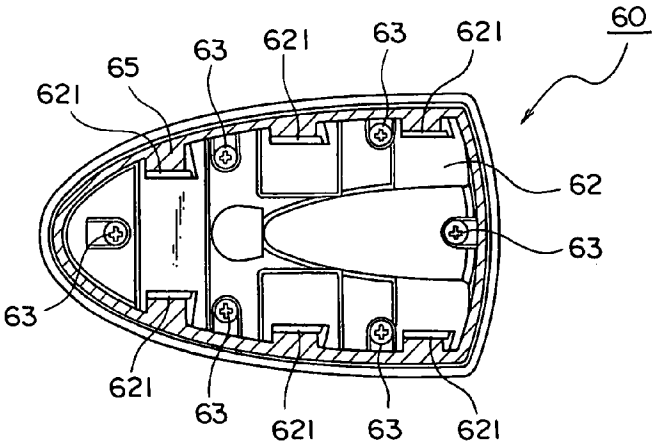
FIG. 2B is a plan view of the antenna body illustrated in FIG. 2A.
Figure 2C:
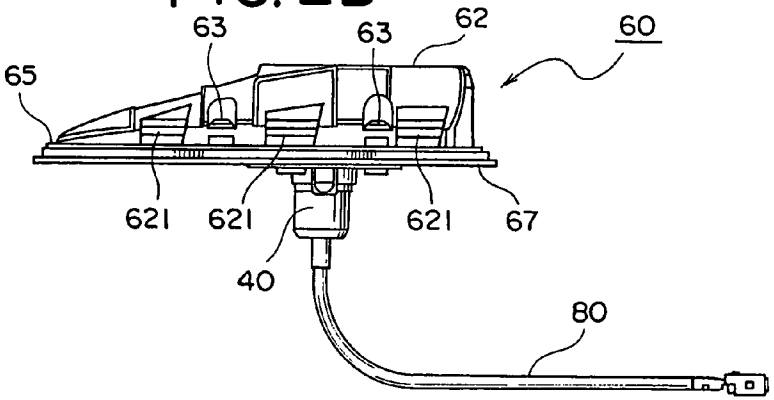
FIG. 2C is a side view of the antenna body illustrated in FIG. 2A.
Figure 2A:
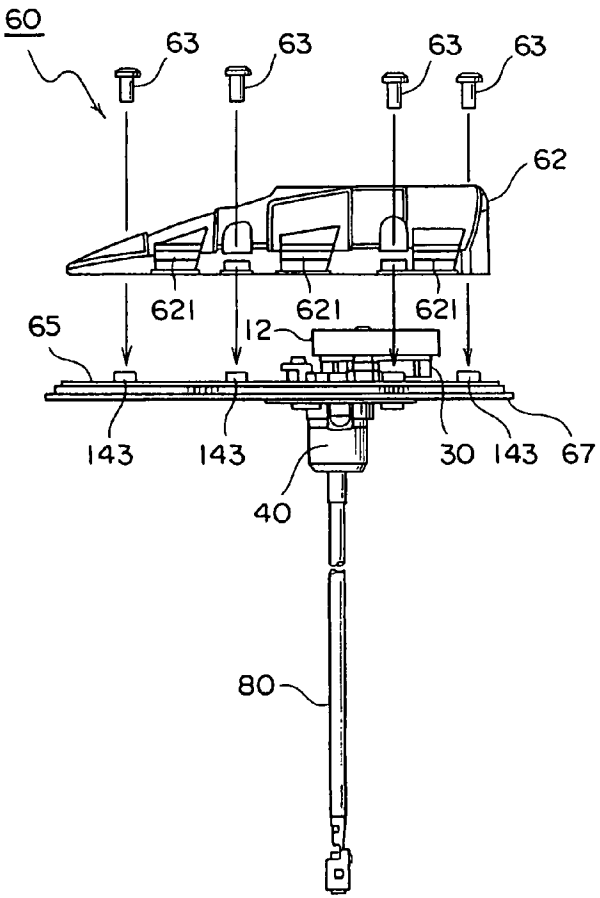
FIG. 2A is an exploded side view of an antenna body in antenna unit illustrated in FIG. 1 where the top cover is removed from the antenna unit.

Referring to FIGS. 2A through 2C in addition to FIG. 1, the description will further proceed to the antenna unit 10. FIGS. 2A through 2C are views showing an antenna body 60 where the top cover (the outer cover), which will later be described, is removed from the antenna unit 10. FIG. 2A is an exploded side view of the antenna body 60. FIG. 2B is a plan view of the antenna body 60. FIG. 2C is a side view of the antenna body 60.

The bottom plate 14 has six bosses 143 for attaching the intermediate cover (the inner cover) 62 on the main surface 14*a* of the bottom plate 14 by means of six screws 63. Each boss 143 has a threaded hole. The intermediate cover (the inner cover) 62 has six through holes (not shown) for passing through screw portions of the six screws 63 at positions corresponding to the above-mentioned six bosses 143.

The intermediate cover (the inner cover) 62 is for covering the antenna 12 including the antenna element 20.

At a surrounding on the main surface 14*a* of the bottom plate 14, a first elastic sheet 65 made of an elastic material such as rubber is mounted. That is, on attaching the intermediate cover (the inner cover) 62 on the main surface 14*a* of the bottom plate 14 by means of the six screws 63, the first elastic sheet 65 is sandwiched between the intermediate cover (the inner cover) 62 and the bottom plate 14. Accordingly, the first elastic sheet 65 acts as a waterproof member and a dustproof member between the intermediate cover (the inner cover) 62 and the bottom plate 14.

The antenna body 60 further comprises a second elastic sheet 67 made of an elastic material for covering at least an outer edge 14*b* (FIG. 1) of the bottom plate 14. The second elastic sheet 67 is also called a gasket or packing. In addition, the illustrated second elastic sheet 67 covers not only the outer edge 14*b* of the bottom plate 14 but also almost area of a bottom surface of the bottom plate 14. In the manner which will later be described, inasmuch as a rim edge of the top cover (the outer cover) comes in contact with a rim edge of the second elastic sheet (the gasket) 67 on fitting the top cover (the outer cover) to the intermediate cover (the inner cover) 62, waterproofing and dustproofing between the top cover (the outer cover) and the antenna body 60 (the bottom plate 14) are made by means of the second elastic sheet (the gasket) 67.

Figure 3A:
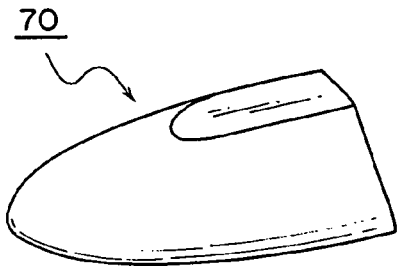
FIG. 3A is an external perspective view showing a top cover which is attached to the antenna body illustrated in FIGS. 2A-2C.
Figure 3B:
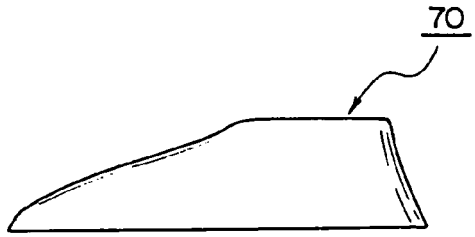
FIG. 3B is a side view of the top cover illustrated in FIG. 3A.
Figure 3C:
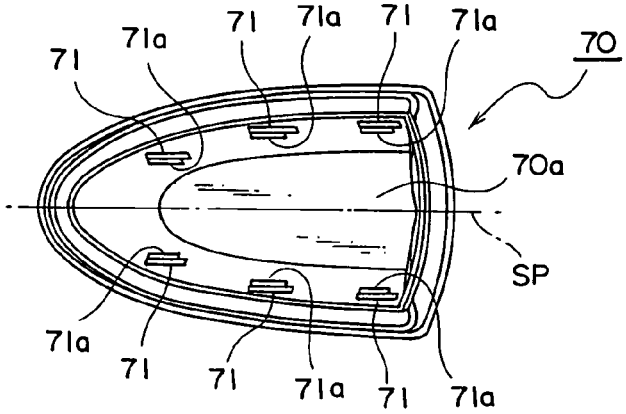
FIG. 3C is a bottom view of the top cover illustrated in FIG. 3A.
Figure 3D:
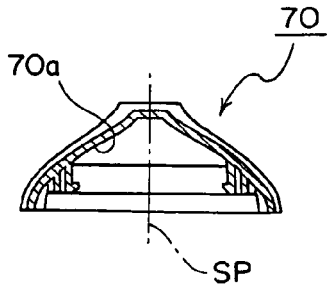
FIG. 3D is a cross-sectional view of the top cover illustrated in FIG. 3A.
Figure 3E:
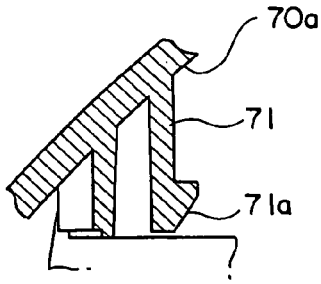
FIG. 3E is a fragmentary cross-sectional view, on an enlarged scale, of a portion of the top cover illustrated in FIG. 3D.

Referring to FIGS. 3A through 3E, the description will proceed to the top cover (the outer cover) depicted at 70 which is attached to the antenna body 60 illustrated in FIGS. 2A-2C. FIG. 3A is an external perspective view showing the top cover 70. FIG. 3B is a side view of the top cover 70. FIG. 3C is a bottom view of the top cover 70. FIG. 3D is a cross-sectional view of the top cover 70. FIG. 3E is a fragmentary cross-sectional view, on an enlarged scale, of a portion of the top cover 70.

The top cover (the outer cover) 70 is fitted to the intermediate cover (the inner cover) 62 so as to cover the intermediate cover (the inner cover) 62, in the manner which will later be described.

The top cover 70 comprises six fixing pieces 71 extending towards the bottom plate 14 in an inner surface 70*a* thereof. Each fixing piece 71 has a stopper claw or hook 71*a* at a tip thereof. Each stopper claw 71*a* projects inwards.

On the other hand, as illustrated in FIGS. 2A-2C, the intermediate cover 6 comprises six engaging parts 621 formed at positions corresponding to the respective six stopper claws 71*a*. The six engaging parts 621 are for receiving the corresponding stopper claws 71*a*, respectively. Accordingly, by engaging the six stopper claws 71*a* with the corresponding six engaging parts 621, the top cover (the outer cover) 70 is fitted to the intermediate cover (the inner cover) 62.

Inasmuch as the antenna unit 10 has a double-covered structure which comprises the top cover (the outer cover) 70 and the intermediate cover (the inner cover) 62, it is possible to comprise the antenna unit 10 only by covering the top cover (the outer cover) 70 painted in one selected from various colors on the antenna body 60 after the antenna body 60 is mounted on the roof of the mobile object (car body).

In other words, inasmuch as the antenna unit 10 has a structure where the top cover (the outer cover) 70 having one of various types of color variation is covered on the antenna body 60 at the last or final process, the antenna body 60 may have only one type and it is possible to very easily manage or control the antenna unit 10.

In addition, inasmuch as the top cover (the outer cover) 70 is fitted to the intermediate cover (the inner cover) 62 by means of a locking mechanism for engaging the stopper claws 71*a* of the six fixing pieces 71 provided in the inner surface 70*a* of the top cover 70 with the six engaging parts 621 of the intermediate cover (the inner cover) 62, it is possible to insert the top cover (the outer cover) 70 to the antenna body 60 with great facility.

As shown in FIGS. 3C and 3D, the illustrated antenna unit 10 has symmetrical structure which is symmetric with respect to a symmetric plane SP. Inasmuch as caught pressure is distributed by substantially symmetrically placing the six stopper claws 71*a* of the six fixing pieces 71 on the inner surface 70*a* of the top cover 70 with respect to the symmetric plane SP and at regular intervals in the above-mentioned embodiment, it is possible to decrease stress with respect to the top cover 70. Although the fixing pieces 71 having the stopper claws 71*a* are placed in the inner surface 70*a* of the top cover 70 at six locations in the above-mentioned embodiment, placed locations of the fixing pieces 71 having the stopper claws 71*a* may be equal in number to six or more.

Inasmuch as the first elastic sheet 65 is sandwiched between the intermediate cover (the inner cover) 62 and the bottom plate 14 and as the rim edge of the top cover (the outer cover) 70 comes in contact with the rim edge of the second elastic sheet (the gasket) 67, it is possible to prevent water and/or dust from permeating and/or intruding into the antenna 12 including the antenna element 20.

Figure 4:
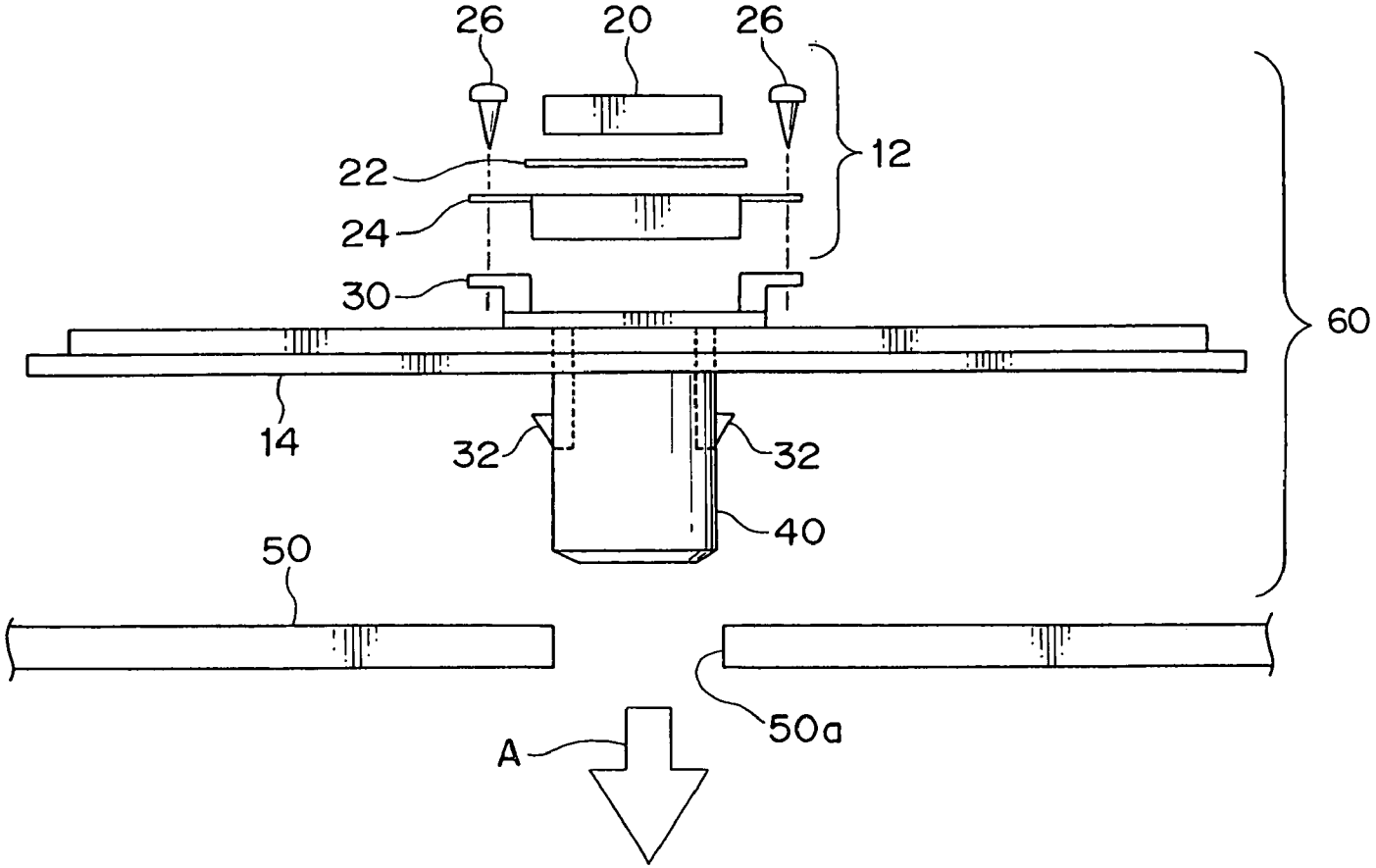
FIG. 4 is a sectional view for describing an operation of provisionally fixing the antenna unit in FIG. 1 onto a roof of a mobile object (car body)
Figure 5:
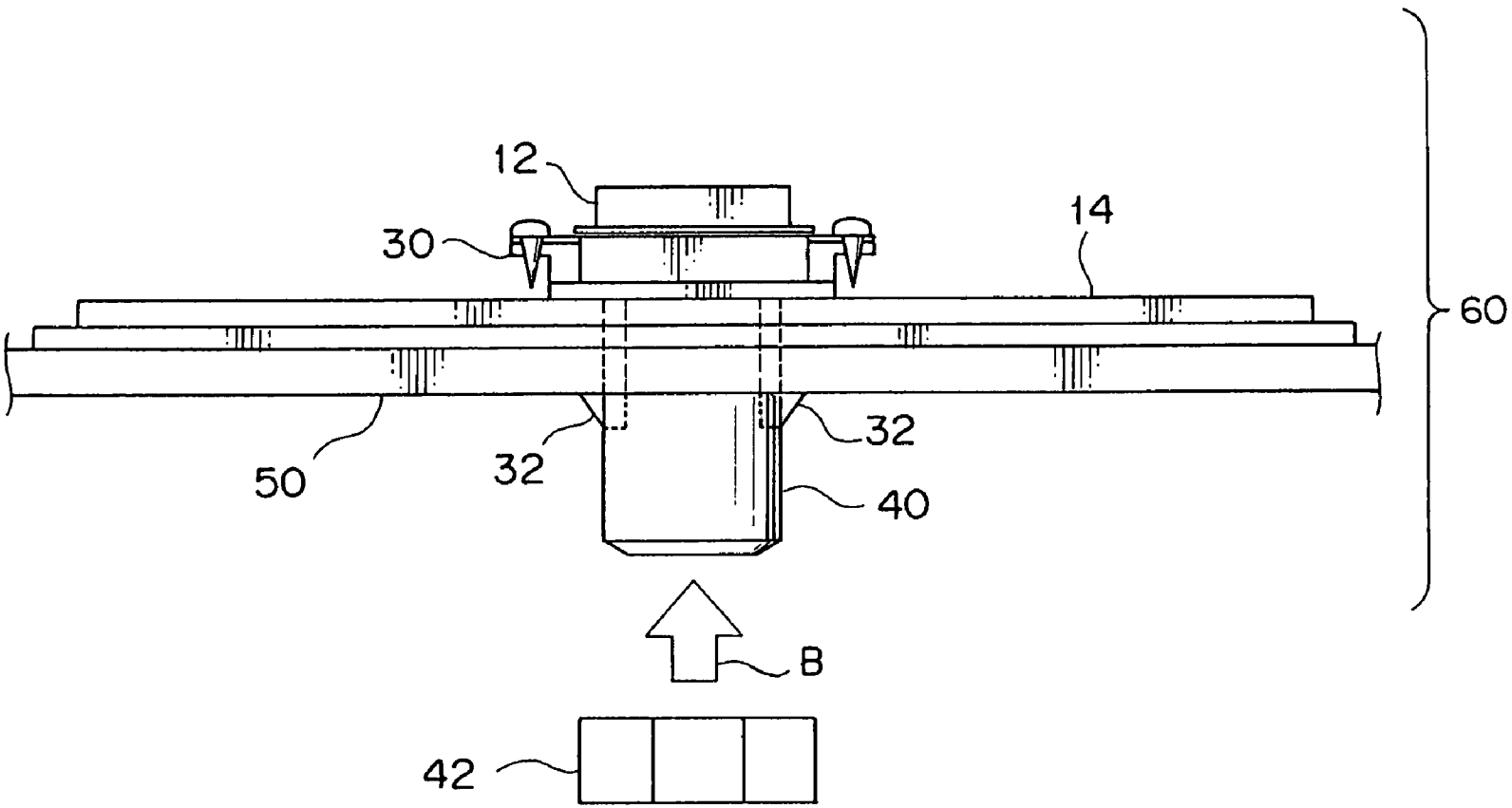
FIG. 5 is a sectional view for describing an operation of permanently fixing the antenna unit provisionally fixed in FIG. 4 onto the roof of the mobile object (car body).

Referring to FIGS. 4 and 5 in addition to FIGS. 1, 2A-2C, and 3A-3E, description will be made of an operation of fixing the antenna unit 10 of the above-mentioned structure to the roof of the mobile object (car body).

At first, as illustrated in FIG. 4, the claws 32 of the unit fixing member 30 are made to pass through the two holes 141*b* of the bottom plate 14, respectively, In this event, the three bosses 142 of the bottom plate 14 are inserted into the boss receiving portions 31 of the unit fixing member 30.

Subsequently, as illustrated in FIG. 4, two of the three screws 26 are threaded in two of the threaded holes 142*a* of the bosses 142 through the through holes 24*b* of the shielding case 24 and two of the three communication holes 31*a* of the unit fixing member 30. In addition, the remaining one of the screws 26 is threaded in the remaining one of the threaded holes 142*a* of the bosses 142 through the remaining one of the communication holes 31*a* of the unit fixing member 30. As a consequence, the antenna 12 is fixed onto the bottom plate 14 through the unit fixing member 30.

Subsequently, as illustrated in FIG. 2A, the intermediate cover (the inner cover) 62 is attached to the main surface 14*a* of the bottom plate 14 by means of the six screws 63 so as to cover the antenna 12. Under the circumstances, the first elastic sheet 65 is sandwiched between the intermediate cover (the inner cover) 62 and the bottom plate 14.

Therefore, the antenna body 60 is assembled, as illustrated in FIGS. 2B and 2C.

In this condition, in the manner which is described above, by fitting the top cover 70 illustrated in FIGS. 3A-3D with the intermediate cover 62, the antenna unit 10 is finished. In this event, the rim edge of the top cover (the outer cover) 70 comes into contact with the rim edge of the second elastic sheet (the gasket or packing) 67.

Then, as depicted by an arrow A in FIG. 4, a cylindrical bolt 40 extending downward from a lower surface of the bottom plate 14 is inserted into an opening 50*a* formed on the roof 50 of the mobile object (car body). Thus, as illustrated in FIG. 5, the antenna unit 10 is provisionally fixed onto the roof 50 of the mobile object (car body) by the claws 32 of the unit fixing member 30.

As depicted by an arrow B in FIG. 5, a nut 42 is engaged with the bolt 40 so that the antenna unit 10 is permanently fixed onto the roof 50 of the mobile object (car body).

While this invention has thus far been described in conjunction with the preferred embodiment thereof, it will now be readily possible for those skilled in the art to put this invention into various other manners. For example, although the antenna unit described in the foregoing embodiment is suitable for the antenna unit for use in the digital radio receiver, the antenna unit according to this invention may not be restricted to this and may be applicable to an antenna unit for use in a GPS receiver or antenna units for use in mobile communications for receiving other satellite waves and other terrestrial waves, and so on.

What is claimed is:

1. An antenna unit comprising:

a bottom plate having a main surface;

an antenna mounted on the main surface of said bottom plate;

an intermediate cover attached on the main surface of said bottom plate so as to cover said antenna; and a top cover fitted to said intermediate cover so as to cover said intermediate cover;

wherein said top cover comprises a plurality of fixing pieces extending towards said bottom plate on an inner surface thereof, each of said fixing pieces having a stopper claw at a tip thereof;

wherein said intermediate cover comprises a plurality of engaging parts for receiving the stopper claws, the engaging parts being provided at positions corresponding to the stopper claws, respectively; and wherein said top cover is fitted to said intermediate cover by engaging said stopper claws with said engaging parts.

2. The antenna unit as claimed in claim 1, wherein said antenna unit has a symmetrical structure which is symmetric with respect to a symmetric plane, and wherein said fixing pieces are substantially symmetrically positioned on the inner surface of said top cover with respect to the symmetric plane.

3. The antenna unit as claimed in claim 2, wherein said fixing pieces are positioned on the inner surface of said top cover at regular intervals.

4. The antenna unit as claimed in claim 3, wherein said top cover comprises at least six of said fixing pieces, and said intermediate cover comprises at least six of said engaging parts.

5. The antenna unit as claimed in claim 1, further comprising an elastic sheet mounted around the main surface of said bottom plate, said elastic sheet being sandwiched between said intermediate cover and said bottom plate.

6. The antenna unit as claimed in claim 1, further comprising a gasket, made of an elastic member, for covering at least an outer edge of said bottom plate, said top cover having a rim edge which comes into contact with a rim edge of said gasket when said top cover is fitted with said intermediate cover.

7. The antenna unit as claimed in claim 1, further comprising:

an elastic sheet mounted around the main surface of said bottom plate, said elastic sheet being sandwiched between said intermediate cover and said bottom plate; and a gasket made, of an elastic member, for covering at least an outer edge of said bottom plate, said top cover having a rim edge which comes into contact with a rim edge of said gasket when said top cover is fitted with said intermediate cover.

8. The antenna unit as claimed in claim 1, wherein said top cover is painted.

9. The antenna unit as claimed in claim 8, wherein said top cover is painted in one color selected from a plurality of colors.

* * * * *